US007225647B2

(12) United States Patent
Derricott

(10) Patent No.: US 7,225,647 B2
(45) Date of Patent: Jun. 5, 2007

(54) LEATHER WORKING TOOL AND METHOD FOR CUTTING A LEATHER STRIP

(76) Inventor: Steven Lloyd Derricott, 2908 Pauley Dr., Boise, ID (US) 83704

( * ) Notice: Subject to any disclaimer, the term of this patent is extended or adjusted under 35 U.S.C. 154(b) by 494 days.

(21) Appl. No.: 10/846,711

(22) Filed: May 14, 2004

(65) Prior Publication Data

US 2005/0252350 A1 Nov. 17, 2005

(51) Int. Cl.
*C14B 19/00* (2006.01)

(52) U.S. Cl. ..... 69/20

(58) Field of Classification Search ..... 69/2, 69/20, 21; 82/12, 123; 83/733
See application file for complete search history.

(56) References Cited

U.S. PATENT DOCUMENTS

| | | | | | |
|---|---|---|---|---|---|
| 86,775 | A | | 2/1869 | Hurn | |
| 2,411,927 | A | * | 12/1946 | Luke | 30/293 |
| 2,559,291 | A | * | 7/1951 | Engeln | 30/283 |
| 2,781,532 | A | | 2/1957 | Hoffman | |
| 2,978,808 | A | * | 4/1961 | Reed | 30/293 |
| 3,080,652 | A | * | 3/1963 | Martinez | 30/283 |
| 3,802,076 | A | * | 4/1974 | Linley | 30/293 |
| 4,131,713 | A | | 12/1978 | Barts et al. | 428/364 |
| 4,218,901 | A | * | 8/1980 | Hacking | 69/21 |
| 4,226,098 | A | | 10/1980 | Alexander | 69/2 |
| 5,027,621 | A | * | 7/1991 | Schiller | 69/2 |

OTHER PUBLICATIONS

Whip Making Tools—website www.em-brand-whips.com [2 pgs].
Hacking Cutter.Com—website www.hackingcutter.com—Hacking Leather & Rawhide String Cutter [7 pgs].
Hought Fine Art and Leather and Endurance Tack—website www.hought.com, Books on Bradiing Leather & Rawhide [7 pgs].

* cited by examiner

*Primary Examiner*—Shaun R. Hurley
(74) *Attorney, Agent, or Firm*—Joseph W. Holland

(57) ABSTRACT

A leather working tool and a method for cutting a leather strip. The strip cutting tool includes a tool head adapted for placement at least partially through the aperture formed through the sheet of material. A tool shaft is attached to and extends from the tool head. A strip cutting blade is connected to and extends parallel to a longitudinal axis of the tool head. The strip cuffing blade is positioned with respect to the tool head at a distance defining a desired strip width. The strip end is pulled between the tool head and the strip cuffing blade, and a continuous strip of a selected width is cut.

16 Claims, 4 Drawing Sheets

LEATHER WORKING TOOL AND METHOD FOR CUTTING A LEATHER STRIP

BACKGROUND OF THE INVENTION

1. Technical Field

The invention relates to leather working machinery, and more particularly to a leather working tool and a method for cutting a leather hide section into a leather strip.

2. Background

The art and craft of leatherwork, particularly leather braiding often require that leather strips be cut from larger animal hide sections, and that these strips be sized consistently, accurately and with repeatability for width and thickness and that the strips, on occasion be beveled removing corners to achieve a more finished appearance. The prior art discloses a variety of devices for working with leather and other durable fabric and sheet materials. The prior art includes both devices designed for performing both singular and multiple functions, for example splitting, cutting strips or laces and beveling. One device that performs a singular function is disclosed in U.S. Pat. No. 4,226,098 to Alexander. This Leather Yarn Producing Machine produces a strand of leather yarn from a leather disc. A cutting wheel is positioned just above the turntable and is rotatably driven on an axis lying generally radially with respect to the turntable. A frame above the turntable supports the cutting wheel and provides for advancement of the cutting wheel radially inwardly as the cutting of leather yarn from the peripheral edge of the leather disc progresses. The speeds of rotation of the turntable and of advancement of the cutter may be increased as the cutting operation moves toward the center of the turntable so that the linear speed of production of the leather yarn is held more or less constant. U.S. Pat. No. 4,131,713 Barta, et al discloses a leather yarn cutting device that includes an upper work surface which supports a circular section of a hide. The hide section is rotated so that the periphery of the leather disc is moved past a cutting blade. The blade cuts the strand from an outer peripheral edge of the leather disc. Each of the above devices are automated in the sense that the hide sections are rotated by a motorized means past a stationary blade.

Several devices are currently available that provide multiple functions. One such device is sold as The Hacking Leather & Rawhide String Cutter, as seen at http://www.hackingcutter.com and which is available at 4064 Aquarius Circle, Salt Lake City, Utah 84118. This device enables the cutting of a hide section to a selected width, cutting of a strip to a selected thickness and cutting of a strip of material to include a beveled edge. A cutter/beveler leather working tool is sold by Hought Fine Art & Leather, P.O. Box 2115, McKinleyville, Calif. 95519 and may be used to cut strips from a hide section and to bevel a strip.

It would therefore be advantageous to provide a leather working tool and a method for cutting a leather hide section into a leather strip which permits initiating the cutting process at or near the center of a leather hide section, working towards the outer edge of the hide section. Additional advantage may be found in providing a leather working tool that combines the capability for cutting a leather hide section into a leather strip starting at or near the center of a leather hide section and working towards the outer edge of the hide section, with the capability to perform beveling and skiving or cutting a strip to a desired thickness. Additionally, advantage may be found in providing a leather working tool that combines the above capabilities with a feature that allows the device to be set up for working in either a right or left handed position.

SUMMARY OF THE INVENTION

These and other objects are achieved by a strip cutting tool for cutting a strip from a sheet of material having an aperture formed in the sheet of material the aperture including a strip end formed at a peripheral edge defining the aperture. The strip cutting tool includes a tool head adapted for placement at least partially through the aperture. A tool shaft is attached to and extends from the tool head. A strip cutting blade is connected to and extends from the shaft along a plane that lies substantially parallel to a longitudinal axis of the tool head. The strip cutting blade is positioned with respect to the tool head at a distance formed through the sheet of material defining a desired strip width. The strip cutting blade is oriented radially with respect to the shaft so that as the strip end is pulled between the tool head and the strip cutting blade, a continuous strip of a selected width is cut from the peripheral edge defining the aperture. The strip cutting blade may be removable and replaceable.

In one preferred embodiment, the strip cutting tool is configured as a leather working tool that includes a tool head having an axis and an aperture formed through the tool head along a plane that lies substantially perpendicular to the axis of the tool head. A tool shaft is inserted through the aperture and a strip cutting blade is connected to the shaft. The shaft may be rotatable and slideable within the aperture of the tool head. In this case, the shaft position, adjustable by sliding the tool shaft through the aperture, and the shaft orientation, adjustable by rotating the tool shaft within the aperture, are fixable by a shaft fixing element which impinges against the shaft restricting movement of the shaft with respect to the tool head.

In one preferred embodiment, the leather working tool also includes a planer assembly attached to the tool head. The planer assembly includes a planing blade having an edge that lies against the tool shaft along a plane that is substantially perpendicular to an axis of the tool head. A workpiece may be fed between the shaft and the planing blade to shave or reduce a thickness of a workpiece. The shaft may include a planing depth slot through which the workpiece may be guided during a planing operation. In addition, or in the alternative, the shaft may include a bevel planing depth slot through which the workpiece may be guided during a planing operation. In one preferred embodiment, the leather working tool includes a clamp assembly for clamping the tool to a stationary object, for instance a work bench.

The present invention is also directed to a method for cutting a leather strip using a leather working tool including a tool head and a strip cutting blade, the strip cutting blade positioned with respect to the tool head at a distance defining a desired strip width. The method may include the steps of punching a hide section at an approximate center point forming a hide section aperture through the hide section. Forming a strip end in the hide section, the strip end formed at a peripheral edge defining the aperture through the hide section. Positioning the hide section on the leather working tool, the hide section aperture positioned about the tool head. Positioning the strip end with a first marginal edge of the strip end placed against the tool head and a second marginal edge of the strip end placed against the strip cutting blade and pulling the strip end drawing the strip end between the tool head and the strip cutting blade, splitting a strip from the peripheral edge defining the aperture thereby forming a strip having a width substantially equal to a distance between the tool head and the strip cutting blade. As the strip end is pulled, a rotational force is imparted to the hide section so that the peripheral edge defining the aperture is continuously fed towards the strip cutting blade.

Additional advantages and novel features of the invention will be set forth in part in the description that follows, and in part will become apparent to those skilled in the art upon examination of the following, or may be learned by practice of the invention. Additionally, the advantages of the invention may be realized and attained by means of the instrumentalities and combinations particularly pointed out in the appended claims.

DETAILED DESCRIPTION OF THE INVENTION

Figure 1:
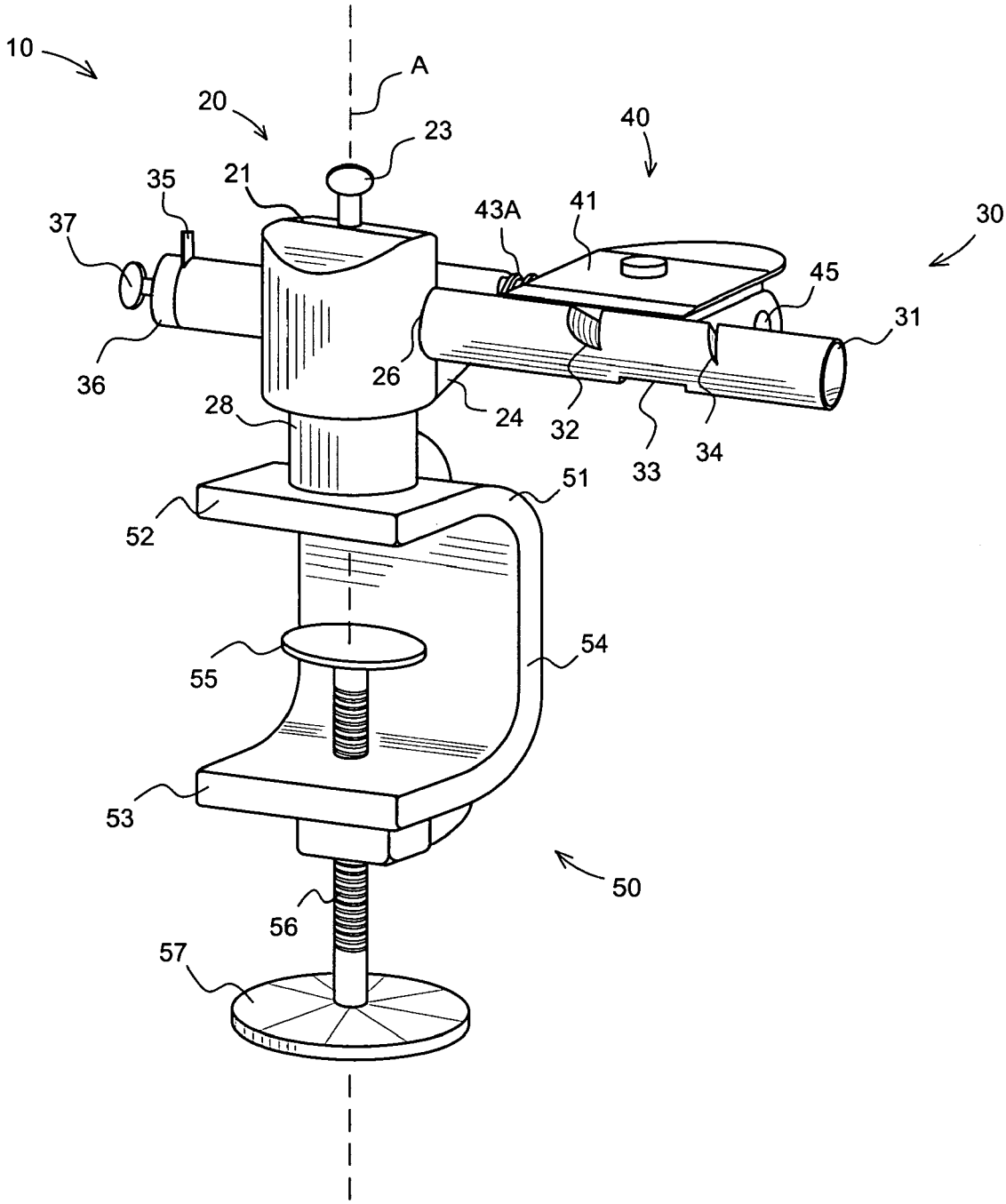
FIG. 1 is a perspective representational view of a leather working tool according to one preferred embodiment of the present invention.

As seen in FIGS. 1-4, leather working tool 10 is shown including tool head assembly 20, tool shaft assembly 30, planer assembly 40 and clamp assembly 50. Referring to FIG. 1, tool head assembly 20 includes tool head 21 having an axis A and an aperture 26 formed substantially perpendicular to axis A. Tool shaft assembly 30 includes shaft 31 that is inserted through aperture 26 of tool head 21. Screw 23 fixes a position of shaft 31 with respect to tool head 21. As shown in FIG. 1 shaft 31 includes three different depth gauging slots, forty-five degree bevel planing depth slot 34, thirty degree bevel planing depth slot 32 and flat planing depth slot 33. Preferably, forty-five degree bevel planing depth slot 34, thirty degree bevel planing depth slot 32 and flat planing depth slot 33 are all formed having eccentric surfaces. This feature allows the depth of the planing cut to be controlled and selected. Shaft 31 may be oriented radially and positioned laterally as required to position either forty-five degree bevel planing depth slot 34, thirty degree bevel planing depth slot 32 or flat planing depth slot 33 at a 12 o'clock position. As seen in FIG. 1, shaft 31 has been oriented by rotation and positioned laterally with respect to axis A, such that thirty degree bevel planing depth slot 32 is positioned under planer assembly 40. Strip cutting blade 35 is held by shaft 31 and is rotatable with shaft 31 to an upright position parallel substantially parallel to axis A. Strip cutting blade 35 may be removed and/or replaced by loosening screw 37 which in turn releases pressure on clamp block 36.

Planer assembly 40 includes planer blade holder 41 which is pivotably mounted to heel 24 of tool head 21 on shaft 45. Spring 43A holds planer blade holder 41 in a biased relationship against tool shaft 31. Clamp assembly 50 includes a generally U-shaped body 51 including opposing upper and lower fingers 52 and 53 respectively and throat 54. Tool head 21 is joined to upper finger 52 at neck 28. Clamp assembly 50 also includes movable head 55 which is attached to screw 56. Clamping force between movable head 55 and upper finger 52 is adjustable using hand wheel 57.

Figure 4:
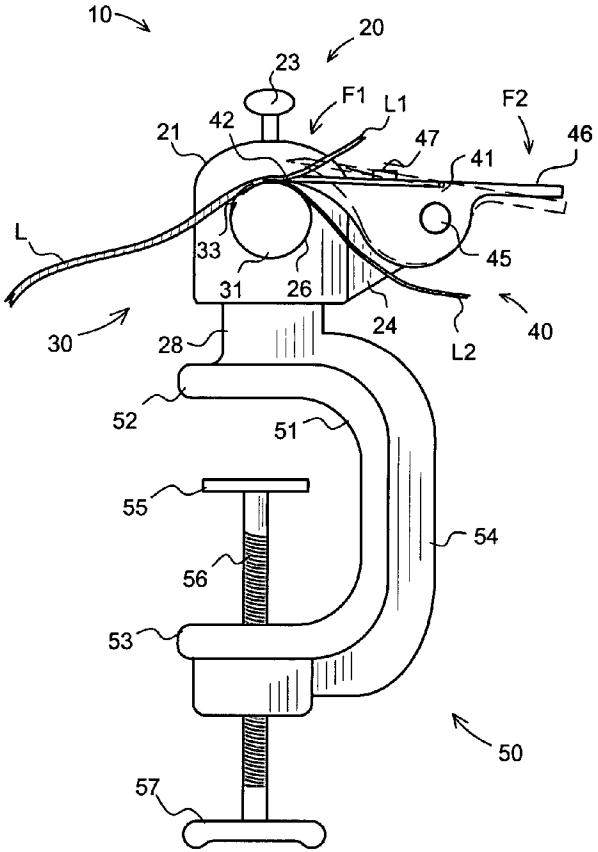
FIG. 4 is a first side representational view of a leather working tool according to one preferred embodiment of the present invention.
Figure 2:
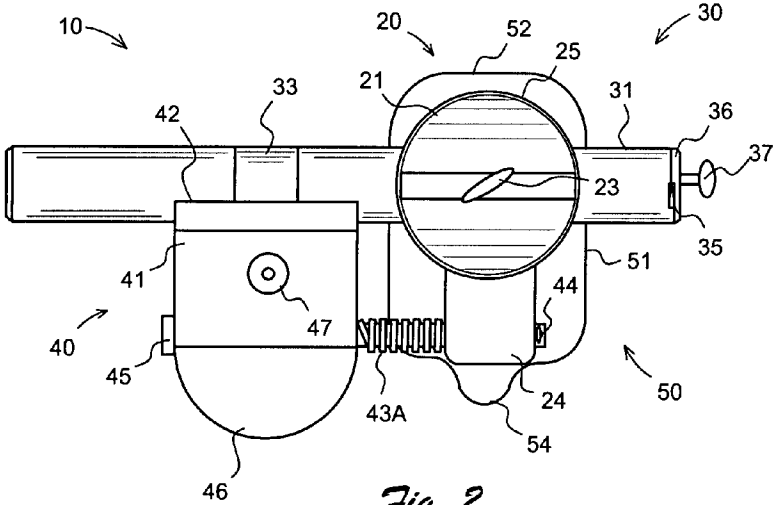
FIG. 2 is a top representational view of a leather working tool assembled for use by a right handed individual according to one preferred embodiment of the present invention.
Figure 3:
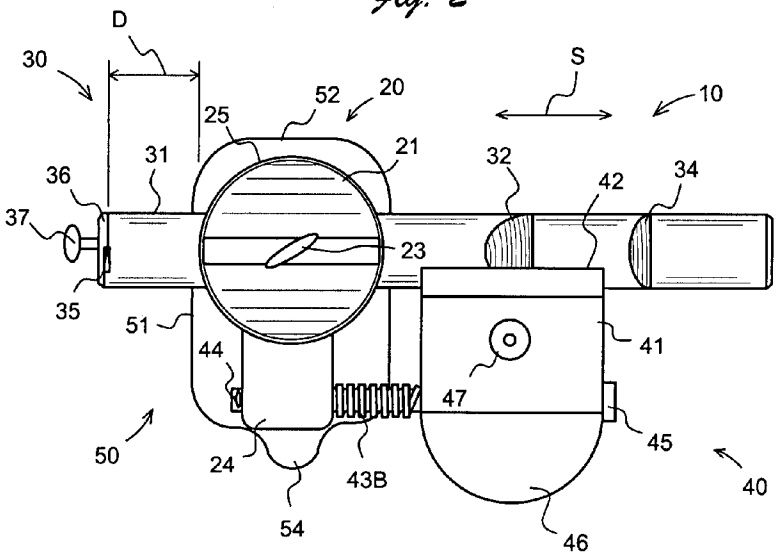
FIG. 3 is a top representational view of a leather working tool assembled for use by a left handed individual according to one preferred embodiment of the present invention.

Referring to FIGS. 2 and 4, leather working tool 10 is shown configured for use in a right hand configuration. In FIG. 3, leather working tool 10 is shown configured for use in a left hand configuration. In each case, tool head assembly 20 includes tool head 21. As seen in FIGS. 2 and 3, outer perimeter 25 of tool head 21 is substantially circular in cross-section. Referring to FIGS. 2 through 4, tool shaft assembly 30 includes shaft 31, which as shown in FIG. 4, is inserted through aperture 26 of tool head 21. Referring to FIGS. 2 through 4, screw 23 fixes a position of shaft 31 with respect to tool head 21. As shown in FIG. 2, shaft 31 has been rotated so that flat planing depth slot 33 is positioned below planer assembly 40. In FIG. 3, shaft 31 has been rotated so that forty-five degree bevel planing depth slot 34 and thirty degree bevel planing depth slot 32 are at a twelve o'clock position and thirty degree bevel planing depth slot 32 is positioned below planer assembly 40. As shown in FIG. 3, shaft 31 may be positioned laterally along direction S as required to position shaft 31 with respect to planer assembly 40. Shaft 31 may also be positioned laterally along direction S as required to select a distance D between strip cutting blade 35 and outer perimeter 25 of tool head 21. Referring to FIGS. 2 and 3, strip cutting blade 35 is held by shaft 31 and may be removed and/or replaced by loosening screw 37 which in turn releases pressure on clamp block 36.

Referring to FIGS. 2 through 4, planer assembly 40 includes planer blade holder 41 which is pivotably mounted to heel 24 of tool head 21 on shaft 45. Screw 47 secures planer blade 42 in planer blade holder 41. Tab 46 provides a lever which as seen in FIG. 4, when a force F2 is applied, lifts planer blade 42 away from tool shaft 31. As seen in FIGS. 3 and 4, retainer 44 secures shaft 45 from removal. Referring to FIG. 2, spring 43A exerts a force F1, shown in FIG. 4, that holds planer blade holder 41 in a biased relationship against tool shaft 31 when leather working tool 10 is assembled for use by a right handed individual. In a right handed configuration, tool shaft 31 is inserted through tool head 21 so that strip cutting blade 35 is set up to the right of tool head 21 and planer assembly 40 is set up to the left of tool head 21. Referring to FIG. 3, spring 43B, having a reverse coil, is required to achieve a biased relationship between planer blade holder 41 and tool shaft 31 when leather working tool 10 is assembled for use by a left handed individual. In a left handed configuration, as seen in FIG. 3, tool shaft 31 is inserted through tool head 21 so that strip cutting blade 35 is set up to the left of tool head 21 and planer assembly 40 is set up to the right of tool head 21. FIG. 4 shows leather working tool 10 being used in a skiving operation wherein leather strip L is directed through flat planing depth slot 33 and is drawn between shaft 31 and planer blade 42 which separates the leather strip L into two sections L1 and L2, the lower section L1 having a selected thickness.

Referring to FIGS. 2 through 4, leather working tool 10 also includes clamp assembly 50. As seen in FIG. 4, clamp assembly 50 includes a generally U-shaped body 54 including opposing upper and lower fingers 52 and 53 respectively and throat 51. Tool head 21 is joined to upper finger 52 at neck 28. Clamp assembly 50 also includes movable head 55 which is attached to screw 56. Clamping force between movable head 55 and upper finger 52 is adjustable using hand wheel 57.

Figure 5:
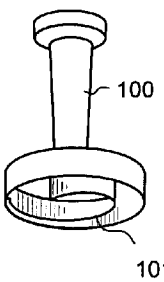
FIG. 5 is a perspective representational view of a leather punch for use in applying a method for cutting a leather strip according to one preferred embodiment of the present invention.
Figure 6:
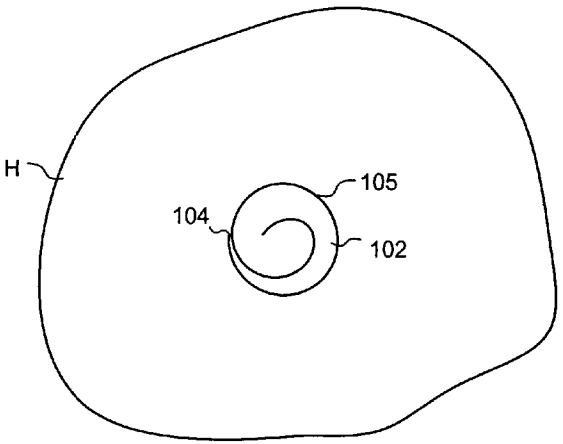
FIG. 6 is a representational view of a portion of a hide positioned for cutting a leather strip according to one preferred embodiment of the present invention.

FIG. 5 shows leather punch 100 which may be used in one step of a method for cutting a leather strip according to one preferred embodiment of the present invention. Leather punch 100 includes punch head 101 which is adapted to provide a substantially circular punch 102, as seen in FIG. 6, in a sheet material, for instance hide section H. Circular punch 102 is located preferably at an approximate center of hide section H and includes strip end 104 formed at a peripheral edge 105 defining circular punch 102.

Figure 7:
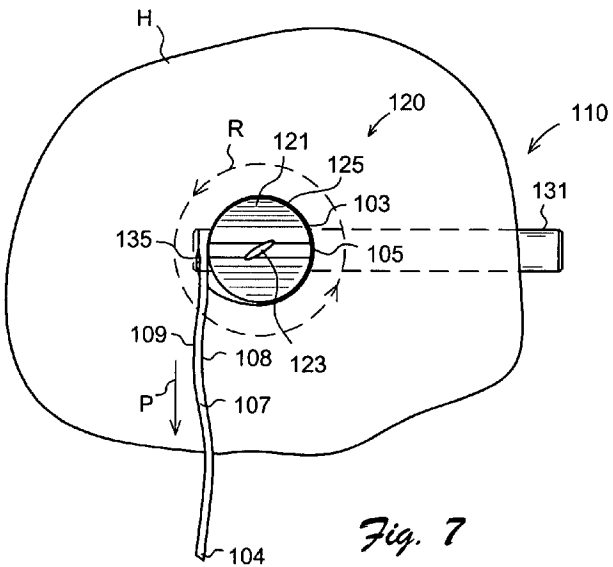
FIG. 7 is a representational view of a portion of a hide positioned for cutting a leather strip according to one preferred embodiment of the present invention.
Figure 8:
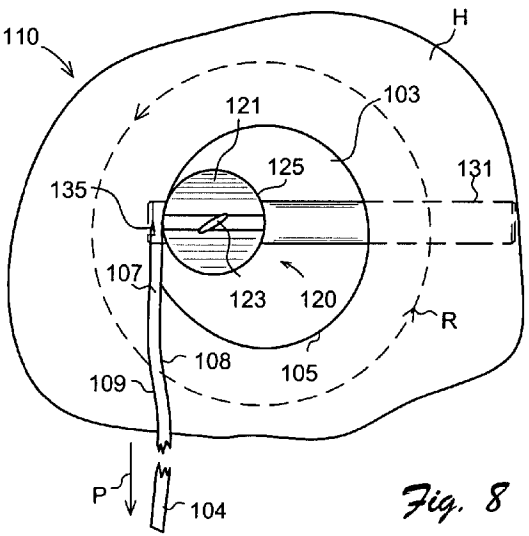
FIG. 8 is a representational view of a portion of a hide positioned for cutting a leather strip according to one preferred embodiment of the present invention.

FIGS. 7 and 8 show a strip cutting tool 110 and a method for cutting a leather disc into a leather strip. As shown in FIG. 7, hide section H is placed over tool head 121 of tool head assembly 120. Tool head 121, is configured having substantially circular cross-section 125, to allow placement of tool head 121 at least partially through aperture 103 formed when circular punch 102, seen in FIG. 6, is removed from hide section H. Hide section H is positioned with respect to tool head 121 such that strip end 104 is placed between strip cutting blade 135 and tool head 121 with a first marginal edge 108 placed against tool head 121 and a second marginal edge 109 placed against strip cutting blade 135, which is shown held at the end of tool shaft 131. As strip end 104 is pulled in a direction indicated generally by the arrow indicated by the reference character P, hide section H is rotated against strip cutting blade 135 as indicated generally by the circle and arrows indicated by the reference character R and strip cutting blade 135 continuously separates strip 107 from the peripheral edge 105 of aperture 103 formed in hide section H. Distance D between strip cutting blade 135 and tool head 121 may be adjusted by loosening screw 123 and adjusting a location of shaft 131 with respect to tool head 121.

Figure 9:
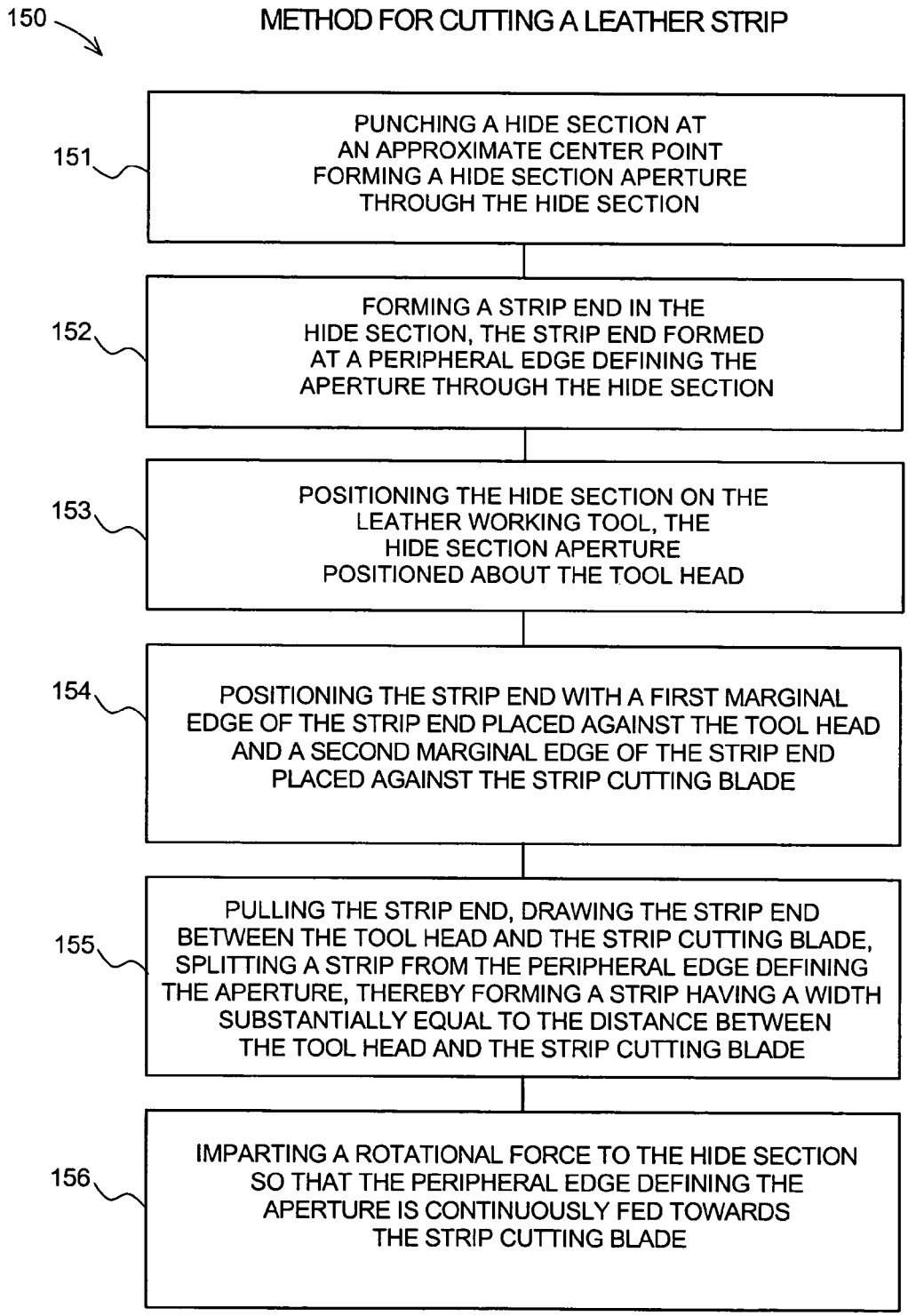
FIG. 9 is a schematic flow diagram depicting a method for cutting a leather strip according to one preferred embodiment of the present invention.

FIG. 9 is a schematic flow diagram depicting a Method for Cutting a Leather Strip 150 using a leather working tool including a tool head and a strip cutting blade, the strip cutting blade positioned with respect to the tool head at a distance defining a desired strip width. The Method for Cutting a Leather Strip 150 includes the steps of Punching a Hide Section at an Approximate Center Point Forming a Hide Section Aperture Through the Hide Section 151, Forming a Strip End in the Hide Section, the Strip End Formed at a Peripheral Edge Defining the Aperture Through the Hide Section 152, Positioning the Hide Section on the Leather Working Tool, the Hide Section Aperture Positioned About the Tool Head 153, Positioning the Strip End with a First Marginal Edge of the Strip End Placed Against the Tool Head and a Second Marginal Edge of the Strip End Placed Against the Strip Cuffing Blade 154, 155 Pulling the Strip End, Drawing the Strip End Between the Tool Head and the Strip Cutting Blade. Splitting a Strip from the Peripheral Edge Defining the Aperture Thereby Forming a Strip Having a Width Substantially Eaual to a Distance Between the Tool Head and the Strip Cutting Blade and Imparting a Rotational Force to the Hide Section so that the Peripheral Edge Defining the Aperture is Continuously Fed Towards the Strip Cutting Blade 156.

It is to be understood that the invention is not limited to the embodiment shown and described above. Various other embodiments of the invention may be made and practiced without departing from the scope of the invention, as defined in the following claims.

I claim:

1. A strip cutting tool for cutting a strip from a sheet of material having an aperture formed through the sheet of material and a strip end formed at a peripheral edge defining the aperture, the strip cutting tool comprising:

a tool head having an axis, the tool head including a substantially circular cross-section configured to allow placement of the tool head at least partially through the aperture formed through the sheet of material;

a tool shaft attached to and extending substantially perpendicular to the axis of the tool head, the tool shaft rotatable and slideably adjustable with respect to the tool head; and a strip cutting blade connected to and rotatable with the shaft, the strip cutting blade extending from the shaft along a plane that lies substantially parallel to the axis of the tool head, the strip cutting blade positioned with respect to the tool head at a distance defining a desired strip width and the strip cutting blade oriented so that as the strip end is pulled between the tool head and the strip cutting blade, a continuous strip of a selected width is cut from the peripheral edge defining the aperture.

2. The strip cutting tool of claim 1 wherein the tool head further comprises a tool head configured to allow placement of the tool head completely through the aperture formed through the sheet of material.

3. The strip cutting tool of claim 1 wherein the tool shaft further comprises a removable tool shaft that may be attached to the tool head in a right handed configuration or, in the alternative, the removable tool shaft may be attached to the tool head in a left handed configuration.

4. The strip cutting tool of claim 1 wherein the strip cutting blade further comprises a replaceable strip cutting blade.

5. A leather working tool comprising:

a tool head having an axis and an aperture formed through the tool head, the aperture oriented on a plane substantially perpendicular to the axis of the tool head, the tool head including a substantially circular cross-section configured to allow placement of the tool head at least partially through the aperture formed through the sheet of material;

a tool shaft inserted through the aperture of the tool head, the tool shaft extending substantially perpendicular to the axis of the tool head, the tool shaft rotatable and slideably adjustable with respect to the tool head; and a strip cutting blade connected to and rotatable with the shaft, the strip cutting blade extending from the shaft along a plane that lies substantially parallel to the axis of the tool head, the strip cutting blade positioned with respect to the tool head at a distance defining a desired strip width and the strip cutting blade oriented so that as a strip end is pulled between the tool head and the strip cutting blade, a continuous strip of a selected width is cut from a peripheral edge defining an aperture formed in a section of hide.

6. The leather working tool of claim 5 wherein the tool head further comprises a tool head configured to allow placement of the tool head completely through the aperture formed through the sheet of material.

7. The leather working tool of claim 5 wherein the tool shaft further comprises removable tool shaft that may be inserted through the aperture of the tool head in a right handed configuration or in the alternative the removable tool shaft may be inserted through the aperture of the tool head in a left handed configuration.

8. The leather working tool of claim 5 further comprising a clamp assembly, the tool head attached to the clamp assembly.

9. The leather working tool of claim 5 wherein the strip cutting blade further comprises a replaceable strip cutting blade.

10. The leather working tool of claim 5 further comprising a rotatable and slideable shaft fixable by a shaft fixing element in a selected position and a selected orientation with respect to the tool head.

11. The leather working tool of claim 5 further comprising:

a planer assembly attached to the tool head, the planer assembly including a planing blade having an edge that lies against the tool shaft along a plane that is substantially perpendicular to an axis of the tool head; and the shaft includes a planing depth slot.

12. The leather working tool of claim 5 further comprising:

a planer assembly attached to the tool head, the planer assembly including a planing blade having an edge that lies against the tool shaft along a plane that is substantially perpendicular to an axis of the tool head; and the shaft includes a bevel planing depth slot.

13. The leather working tool of claim 5 further comprising:

a planer assembly attached to the tool head, the planer assembly including a planing blade having an edge that lies against the tool shaft along a plane that is substantially perpendicular to an axis of the tool head; and the shaft includes a flat planing depth slot.

14. The leather working tool of claim 5 further comprising:

a planer assembly attached to the tool head, the planer assembly including a planing blade having an edge that lies against the tool shaft along a plane that is substantially perpendicular to an axis of the tool head; and the shaft includes a thirty degree bevel planing depth slot.

15. The leather working tool of claim 5 further comprising:

a planer assembly attached to the tool head, the planer assembly including a planing blade having an edge that lies against the tool shaft along a plane that is substantially perpendicular to an axis of the tool head; and the shaft includes a forty-five degree bevel planing depth slot.

16. A method for cutting a leather strip using a leather working tool including a tool head and a strip cutting blade, the strip cutting blade positioned with respect to the tool head at a distance defining a desired strip width, the method for cutting a leather strip including the steps of:

punching a hide section at an approximate center point forming a hide section aperture through the hide section;

forming a strip end in the hide section, the strip end formed at a peripheral edge defining the aperture through the hide section;

positioning the hide section on the leather working tool, the hide section aperture positioned about the tool head;

positioning the strip end with a first marginal edge of the strip end placed against the tool head and a second marginal edge of the strip end placed against the strip cutting blade;

pulling the strip end drawing the strip end between the tool head and the strip cutting blade, splitting a strip from the peripheral edge defining the aperture thereby forming a strip having a width substantially equal to a distance between the tool head and the strip cutting blade; and imparting a rotational force to the hide section so that the peripheral edge defining the aperture is continuously fed towards the strip cutting blade.

* * * * *